US006718603B2

(12) United States Patent
Massotte

(10) Patent No.: US 6,718,603 B2
(45) Date of Patent: Apr. 13, 2004

(54) APPARATUS AND METHOD FOR PRODUCING FRIEZE YARNS

(75) Inventor: Philippe Massotte, Gueberschwihr (FR)

(73) Assignee: Superba (SA), Mulhouse (FR)

( * ) Notice: Subject to any disclaimer, the term of this patent is extended or adjusted under 35 U.S.C. 154(b) by 0 days.

(21) Appl. No.: 10/323,295

(22) Filed: Dec. 18, 2002

(65) Prior Publication Data

US 2003/0115729 A1 Jun. 26, 2003

Related U.S. Application Data

(60) Provisional application No. 60/346,559, filed on Jan. 8, 2002.

(30) Foreign Application Priority Data

Dec. 21, 2001 (FR) ..... 01 16757

(51) Int. Cl.[7] ..... D02G 1/12
(52) U.S. Cl. ..... 28/266; 28/267
(58) Field of Search ..... 28/263, 264, 265, 28/266, 267, 262, 268, 269, 258, 247, 255, 254, 221

(56) References Cited

U.S. PATENT DOCUMENTS

| | | | | | |
|---|---|---|---|---|---|
| 2,514,557 | A | * | 7/1950 | Pfau | 28/267 |
| 2,575,781 | A | * | 11/1951 | Barach | 28/267 |
| 2,575,833 | A | * | 11/1951 | Pfau et al. | 28/267 |
| 2,575,838 | A | * | 11/1951 | Rainard | 28/266 |
| 2,734,228 | A | * | 2/1956 | Hay | 28/267 |
| 3,108,352 | A | * | 10/1963 | Haigler, Jr. et al. | 28/266 |
| 3,147,533 | A | * | 9/1964 | Baer | 28/263 |
| 3,234,625 | A | * | 2/1966 | Trifunovic et al. | 28/264 |
| 3,292,230 | A | | 12/1966 | Čech | |
| 3,309,751 | A | | 3/1967 | Heijnis et al. | |
| 3,587,145 | A | | 6/1971 | McKinney | |
| 3,636,149 | A | | 1/1972 | Tambini | |
| 3,639,955 | A | | 2/1972 | Fleissner et al. | |
| 4,115,907 | A | | 9/1978 | Lawson et al. | |
| 4,268,940 | A | * | 5/1981 | Kuroda et al. | 28/267 |
| 4,854,020 | A | * | 8/1989 | Wagner et al. | 28/255 |
| 4,854,021 | A | | 8/1989 | Reinehr et al. | |
| 5,419,023 | A | | 5/1995 | Hawkins et al. | |
| 5,485,662 | A | * | 1/1996 | Hodges et al. | 28/263 |
| 5,647,109 | A | | 7/1997 | Steiner et al. | |
| 6,253,431 | B1 | * | 7/2001 | Ames et al. | 28/283 |
| 6,385,827 | B1 | * | 5/2002 | Stewart et al. | 28/267 |

FOREIGN PATENT DOCUMENTS

| | | |
|---|---|---|
| EP | 629 722 A1 | 3/1994 |
| FR | 2 212 450 | 8/1974 |
| GB | 1 415 655 | 11/1975 |
| WO | WO 00/05962 | 9/2000 |

* cited by examiner

*Primary Examiner*—Amy B. Vanatta
(74) *Attorney, Agent, or Firm*—Alston & Bird LLP

(57) ABSTRACT

A method for crimping yarn wherein the yarn is fed into a compaction channel of a stuffer box to obtain uniform crimping, and the crimped yarn is pre-set and guided to the outlet of the stuffer box by a pre-setting fluid. A pre-setting and guiding chamber of the stuffer box has a cross-section of generally polygonal shape that is larger than that of the compaction channel.

33 Claims, 4 Drawing Sheets

APPARATUS AND METHOD FOR PRODUCING FRIEZE YARNS

CROSS-REFERENCE TO RELATED APPLICATION

The present application claims the benefit of U.S. Provisional Patent Application No. 60/346,559 filed Jan. 8, 2002.

FIELD OF THE INVENTION

The present invention relates to the textile industry, in particular to the treatment of yarns by crimping, and relates to a method of crimping yarns. The invention also relates to a device for carrying out this method.

BACKGROUND OF THE INVENTION

The crimping of textile fibers or yarns using devices generally referred to as stuffer boxes is carried out by a known method. This method consists in directing the yarns to be crimped between two driving rollers that force the yams into a compaction channel. This compaction channel is usually equipped, at the opposite end to the rollers, with a flapper for compacting the yarns inside the stuffer box. The aim of the flapper or similar device is to increase the friction of the fibers or yarns against the walls of the compaction box to the point where the material to be crimped will lose, as it emerges from the driving rollers, its appearance in a longitudinal form and take on an undulating appearance created by the yarns rubbing downstream against the walls of the stuffer box.

The undulation obtained is referred to as primary crimping and this crimping may be very uniform, but if the compaction chamber is of inappropriate volume or geometry, the primary crimping will tend to become secondary crimping which will have the effect of compacting the material differently and, consequently, will tend to make the primary uniform crimping disappear.

In general, stuffer boxes use a thermal fluid, namely steam, to achieve all or part of the crimping. This steam is injected via orifices situated in the walls of the compaction chamber in such a way that the material to be crimped has a tendency to be pushed out of the stuffer box. This results in the need to apply an even more considerable braking force at the outlet of the stuffer box, so the material tends to acquire even more secondary crimping and consequently lose even more primary crimping.

Crimping machines for carrying out such a method are known in particular from FR-A-2 652 359 and U.S. Pat. No. 5,647,109. In these machines, it is impossible to create and maintain the uniform crimping of the fibers or yarns, owing to the fact that the geometry of the compaction box and/or the system of heat treatment cause its destruction.

SUMMARY OF THE INVENTION

The object of the present invention is to overcome these drawbacks by proposing a method and a device for crimping yarns which results in perfectly uniform crimping, without the formation of secondary or parasitic crimping.

For this purpose, the method of crimping yarns includes the steps of making the yarns pass through an initial compaction zone of a stuffer box to obtain uniform crimping, then, in a second zone, in causing pre-setting of the resultant uniform crimping as well as guidance of the yarn to the outlet of the stuffer box by means of a pre-setting fluid.

The invention also relates to a device for carrying out this method, in the form of a stuffer box equipped with a compaction chamber comprising driving rollers working in cooperation with doctor blades and a pre-setting and guiding chamber for the crimped yarns, wherein the cross-section of the compaction chamber is adjustable and the pre-setting and guiding chamber has a cross-section greater than that of the sliver of resultant crimped yarns such that one or more spaces are defined around the sliver being related to the delivery means for the pre-setting fluid.

BRIEF DESCRIPTION OF THE DRAWINGS

The invention will be better understood from the following description which relates to a preferred embodiment, given as a non-restrictive example and explained with reference to the accompanying diagrammatic drawings in which.

DETAILED DESCRIPTION OF PREFERRED EMBODIMENTS

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
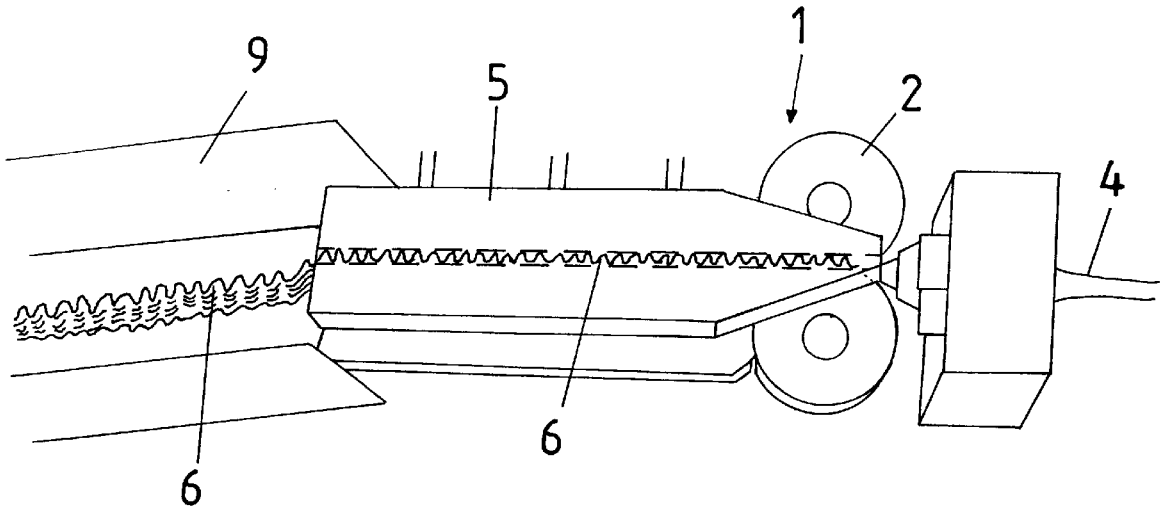
FIG. 1 is a partial view illustrating a device according to one embodiment of the invention.
Figure 2:
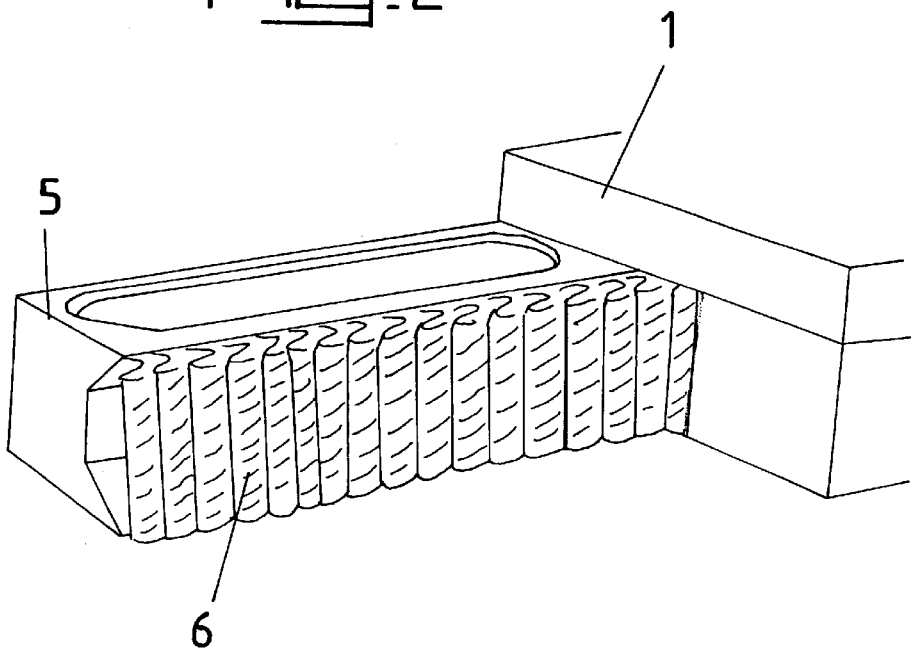
FIG. 2 is a partial view in perspective on a larger scale, illustrating the outlet of the compaction chamber and the pre-setting and guiding chamber for the resultant sliver, this latter chamber being only partially illustrated.
Figure 3:
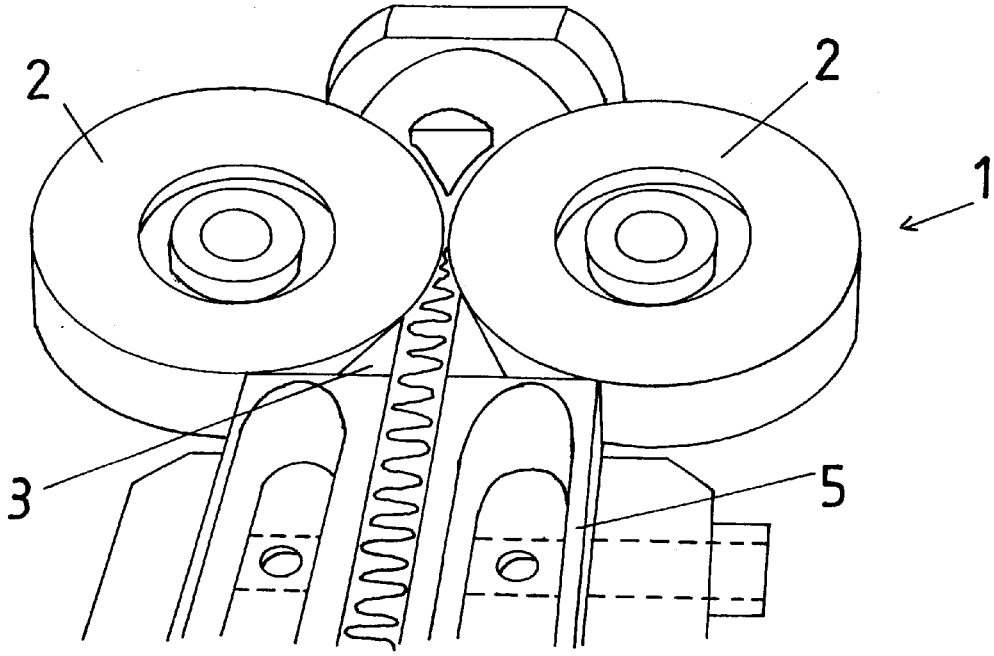
FIG. 3 is a partial view in perspective, on a larger scale and in section, of the compaction chamber linked to the inlet of the pre-setting and guiding chamber.

FIG. 1 of the accompanying drawings illustrates, as an example, a device for crimping textile fibers or yarns in the form of a stuffer box equipped with a compaction chamber 1 comprising driving rollers 2 working in co-operation with doctor blades 3 (FIGS. 3 and 4) and pre-setting and guiding chamber 5 for crimped yarns 6.

According to the invention, this device employs a method which consists substantially in making the yarns 4 pass through an initial compaction zone of a stuffer box to obtain uniform crimping 6, then in causing, in a second zone 5, pre-setting of the resultant uniform crimping 6, as well as guidance thereof, to the outlet of the stuffer box by means of a pre-setting fluid. As those skilled in the art will understand, steam constitutes a suitable pre-setting fluid.

According to a characteristic of the invention, the adjustment and the initial formation of the crimping are produced by retention of the ends of the fibers or yarns engaged in the stuffer box, downstream of the compaction chamber 1. In this way the fibers or yarns, which pass between the driving rollers 2 and are pushed between the doctor blades 3, are initially retained in the pre-setting and guiding chamber 5 in order to produce initial crimping which corresponds to the desired crimping characteristics. The fiber or yarn retention time for the start of the crimping of a sliver is determined according to the mechanical characteristics of the fibers and yarns themselves and those of the desired crimping and are advantageously listed in a table or a chart which allows a rapid adjustment of the stuffer box for each type of textile fiber or yarn.

According to a further characteristic of the invention, the pre-setting of the resultant uniform crimping 6, as well as the guidance thereof to the outlet of the stuffer box, are advantageously produced by means of the presetting fluid which acts on at least part of the section of resultant crimped sliver, in a free space of the pre-setting and guiding chamber.

For carrying out this method, the device in the form of a stuffer box is characterized in that the cross-section of the compaction chamber 1 is adjustable and in that the pre-setting and guiding chamber 5 has a cross-section greater than that of the compaction chamber and therefore greater than that of the sliver of resultant crimped yarns 6, the supplementary space or spaces defined around the sliver 6 being related to the delivery means of the pre-setting fluid.

The compacting chamber 1, which is made up of driving rollers 2 and doctor blades 3, is adjustable in its cross-section owing to the provision of means 7 and 8 which allow, on one hand, a coming together of the two doctor blades 3 and, on the other hand, a displacement of the inlet section of the doctor blades 3 in the direction of or away from the driving rollers 2. The adjusting means 7 which allows the coming together of the two doctor blades 3 is illustrated in FIG. 4 of the accompanying drawings in the form of a reverse threaded element or screwed element, but may also very well be in the form of a pair of synchronized jack screws or an articulated control rod assembly bringing together or spreading apart the doctor blades 3.

Figure 4:
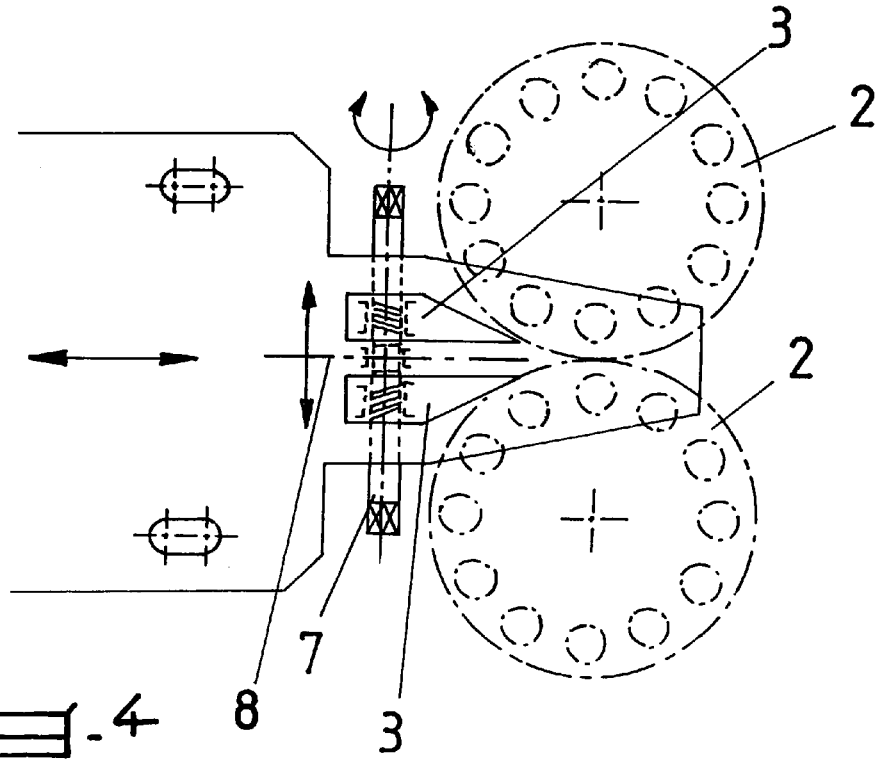
FIG. 4 is a diagrammatic view from above illustrating the adjustment of the cross-section of the compaction chamber.

The means 8, which is intended to produce the displacement of the doctor blades inlet in the direction of the driving rollers 2 or in the opposite direction to these driving rollers 2, is illustrated simply in FIG. 4 by a center line and may equally well be either in the form of a screw and nut drive acting on a guidance and support means common to the doctor blades 3, or individual synchronized drives of the doctor blades.

Preferably, the adjustment in spacing of these doctor blades 3 and the adjustment thereof in relation to the driving rollers 2 are carried out by a centralized control unit synchronizing the two adjusting movements. In fact, it is necessary to carry out simultaneously or almost simultaneously the adjustment of the opening of the doctor blades 3 and their positioning in relation to the driving rollers 2, in order to quickly have available the best adjustment thereof.

The compaction chamber 1 opens into the pre-setting and guiding chamber 5 for the resultant uniform crimping 6, which has an internal cross-section greater than that of said crimping 6 and is equipped on its internal faces with delivery means for the pre-setting fluid, in the form of nozzles or the like, not illustrated. Preferably, the internal cross-section of the chamber 5 is arranged in such a way as to define on at least one side of the sliver of resultant crimped yarns 6 a free space 5', of any geometry. This space 5' allows expansion of the pre-setting fluid without the latter exerting a strong pressure on the sliver of crimped yarns 6, this pressure being, however, sufficient to guide said sliver dynamically in the chamber 5, that is to say to further its progression in said chamber toward the outlet thereof on a conveying or receiving device 9 (FIG. 1).

Figure 8:
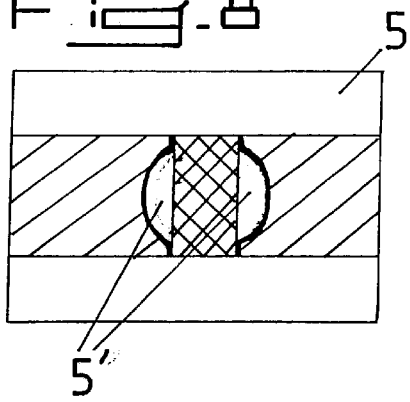
Figure 9:
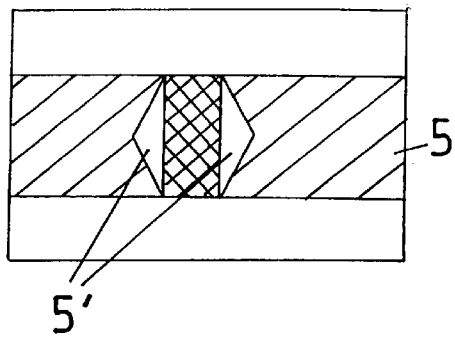
Figure 10:
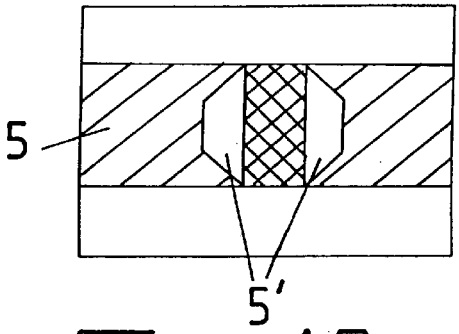
Figure 11:
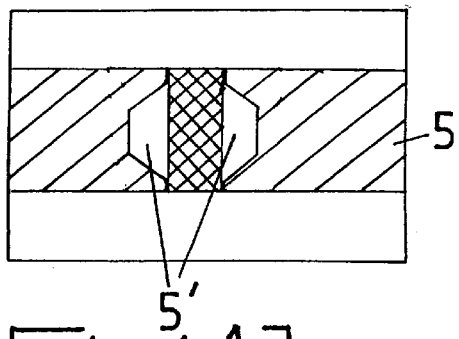
Figure 12:
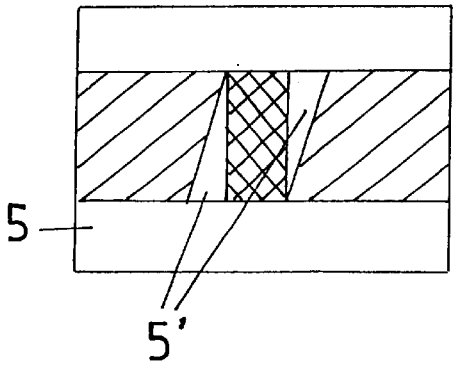
Figure 13:
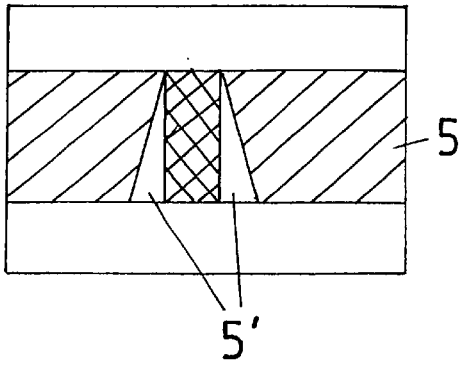

As shown in FIGS. 6 to 13 of the accompanying drawings, the internal cross-section of the chamber 5 may be of the regular or irregular polygon type and define a space 5' on only one side of the sliver of crimped yarn 6 or on both sides of this sliver. Preferably, the internal cross-section of the chamber 5 will have such a configuration that the spaces 5', of slightly smaller height than the height of the sliver of crimped yarns 6, are defined on either side of said sliver 6 so that they rest edgewise against the corners thereof (FIGS. 8 and 11).

According to a further characteristic of the invention, not illustrated in the accompanying drawings, the cross-section of sliver of crimped yarns may equally well be adjustable in height by the provision, in the region of the doctor blades 3, of movable guide means sliding between said doctor blades, in the direction of their vertical axis. In the foregoing, reference is made to a vertical axis of the doctor blades which corresponds, in fact, to the direction of the axes of the driving rollers 2. Obviously, this concept of the verticality of the doctor blades is solely intended to explain the positioning and the displacement of the adjusting means for the height of the sliver of crimped fibers 6 in relation to the width of this sliver, given that the stuffer box may equally well have a vertical orientation of the axes of the driving rollers as a horizontal one.

Figure 5:
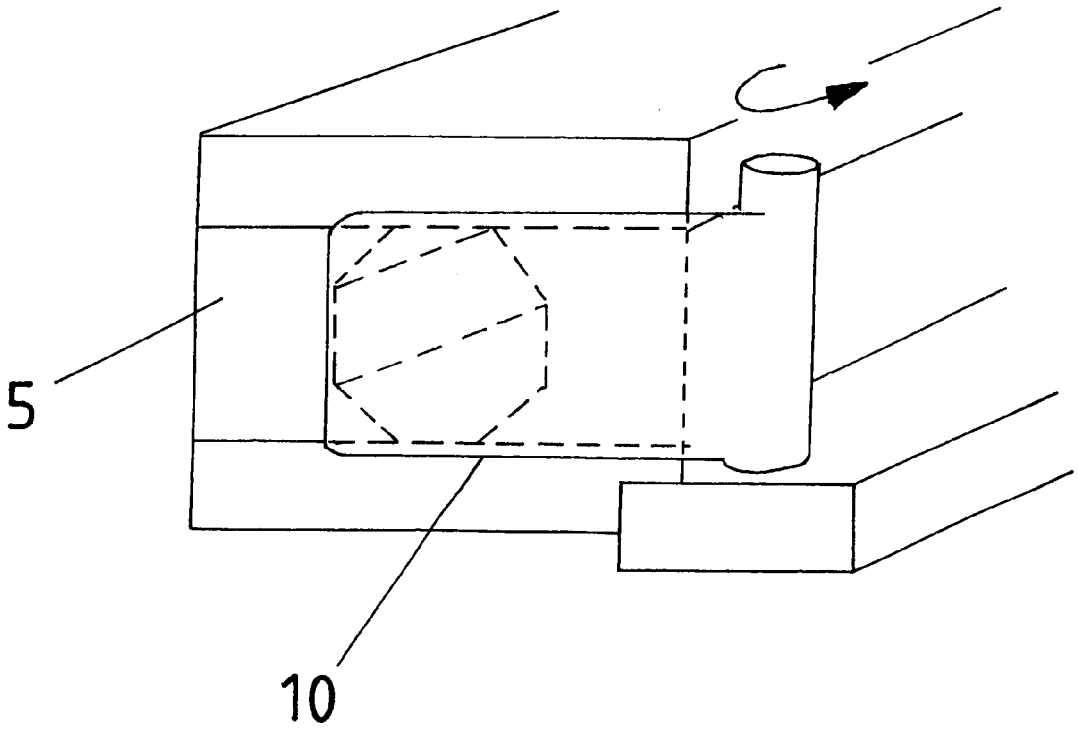
FIG. 5 is a partial view in perspective illustrating the means for initial adjustment of the crimping.
Figure 6:
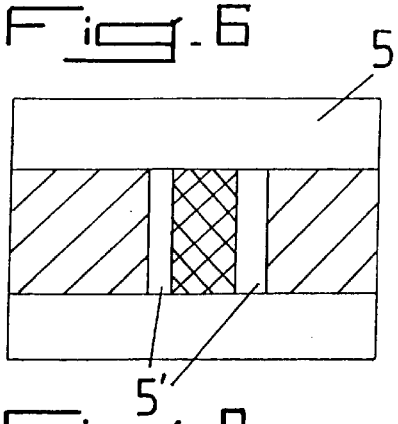
FIGS. 6 to 13 are views in cross-section illustrating different geometries of the pre-setting and guiding chamber.
Figure 7:
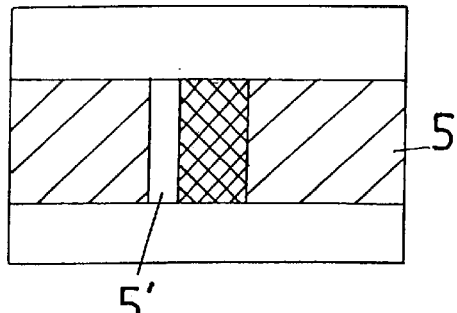

According to a further characteristic of the invention, the device is additionally equipped, at the end of the pre-setting and guiding chamber 5 opposite the one connected to the compaction chamber 1, with a retaining means 10 for the fibers or yarns, at the beginning of a crimping process. This means 10 may advantageously be made in the form of a flapper (FIG. 5) installed in front of the outlet of said chamber 5 and able to be activated by means of a driving device not illustrated, the triggering of which to open and close is preferably produced by means of a programmable controller and/or a manual control. Such a driving device may be in particular in the form of a rotating jack screw or a jack screw acting on the axis of the flapper by means of a lever or also in the form of an electric stepping motor. The programmable controller able to control such a flapper is also of a type known to a person skilled in the art and may, for example, take into consideration numerical data predetermined by a learning adjustment means. Thus, it is sufficient, in the first stage, to produce a preliminary crimping test for each type of product used, in order to determine the adjustment characteristics which will produce the crimping values desired according to the yarn count of the product to be treated and the advancing speed of the yarns and to list these data on a table or chart and then simply program the machine according to the product data and the data of the final material to be obtained. The preliminary adjustment may, for example, be produced by activating the flapper 10 by means of a manual control.

At the beginning of the crimping process for yarns or fibers, the machine starts up automatically with the flapper 10 in the closed position for a predetermined length of time corresponding to the production of primary initial crimping corresponding to the crimping to be obtained, then said flapper 10 is automatically opened and the crimping process may proceed as normal.

In addition, in order to avoid the formation of condensation following the starting up of the machine, the upper and lower walls of the pre-setting and guiding chamber 5 may advantageously be equipped with an integrated electric or hot fluid circulation heating means.

In order to allow quality control of the sliver of crimped yarns 6, at least a part of the wall of the pre-setting and guiding chamber 5 can comprise transparent material. In this way, it is possible to carry out visual monitoring of the sliver 6 and to monitor the consistency of the product characteristics.

According to a characteristic of the invention, not illustrated in the accompanying drawings, the transparent wall may also be equipped with an optical means of monitoring of the resultant product, working in cooperation with an electronic comparison device. Such an optico/electronic monitoring installation, which uses means known to a person skilled in the art, is not disclosed in more detail. This installation makes it possible to carry out verifications by comparison with data stored in an electronic memory and linked to a programmable controller or a computerized monitoring and central control system to act on the working parameters of the machine.

Thanks to the invention, it is possible to carry out crimping of yarns in a stuffer box with perfect control of the uniformity of the crimp, the crimp being exposed during part of its passage through the stuffer box to pre-setting fluid, which simultaneously guides the sliver of crimped yarns dynamically to the outlet of the stuffer box, all this while using a space occupied exclusively by pre-setting fluid.

In addition, the geometry of the pre-setting and guiding chamber 5 allows perfect preservation of the primary crimp created in the compaction chamber 1.

However, the invention also makes it possible, by specifically controlled use of the flapper 10 forming the retention means during crimping, to produce a non-uniform crimp, namely primary and secondary crimp, as it is possible with currently known machines.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method for crimping yarn, comprising the steps of:

feeding the yarn into a channel of a compaction chamber so as to impart a substantially uniform crimping to the yarn; and pre-setting the substantially uniformly crimped yarn by passing the crimped yarn from the compaction chamber into a pre-setting and guiding chamber defining a passage through which the crimped yarn passes, the passage having a cross section greater than that of the channel of the compaction chamber such that a free space is defined between at least one side of the crimped yarn and an adjacent wall of the passage, and wherein a pre-setting fluid is fed into the passage of the pre-setting and guiding chamber to pre-set the crimping of the yarn and to act on said at least one side of the crimped yarn so as to guide the yarn's progress through and out from the passage.

2. The method of claim 1, wherein adjustment and initial formation of the crimping are produced by feeding an end of the yarn through the compaction chamber and into the pre-setting and guiding chamber and causing the end of the yarn to be retained therein.

3. The method of claim 1, wherein the passage is configured such that on each of two opposite sides of the crimped yarn a free space is defined between the yarn and an adjacent wall of the passage.

4. The method of claim 3, wherein the passage of the pre-setting and guiding chamber is configured such that said free spaces have a height slightly less than a height of the crimped yarn, whereby portions of the adjacent walls of the passage rest against corner regions of the crimped yarn.

5. The method of claim 1, wherein the compaction chamber includes a pair of spaced, opposed doctor blades defining the channel therebetween, the yarn being fed into the channel by a pair of opposed driving rollers.

6. The method of claim 5, further comprising the step of adjusting a distance between the doctor blades by moving the doctor blades toward or away from each other.

7. The method of claim 6, further comprising the step of moving the doctor blades toward or away from the driving rollers so as to displace an inlet of the compaction chamber toward or away from the driving rollers.

8. The method of claim 7, wherein movement of the doctor blades toward or away from each other is synchronized with movement of the doctor blades toward or away from the driving rollers.

9. The method of claim 1, further comprising the step of heating walls of the passage of the pre-setting and guiding chamber to prevent condensation thereon.

10. The method of claim 5, further comprising the step of adjusting a height of the crimped yarns by adjusting a dimension of the channel of the compaction chamber in a direction of vertical axes of the doctor blades.

11. A device for crimping yarn, comprising:

a compaction chamber defining a channel therethrough and driving rollers operable to feed a yarn into the channel so as to impart a substantially uniform crimping to the yarn; and a pre-setting and guiding chamber defining a passage connected to an outlet of the channel of the compaction chamber for receiving the crimped yarn, the passage having a cross section greater than that of the channel such that a free space is defined between at least one side of the crimped yarn and an adjacent wall of the passage, and wherein the device is operable to feed a pre-setting fluid into the passage of the pre-setting and guiding chamber to pre-set the crimping of the yarn and to act on said at least one side of the crimped yarn so as to guide the yarn's progress through and out from the passage.

12. The device of claim 11, wherein the passage is configured such that on each of two opposite sides of the crimped yarn a free space is defined between the yarn and an adjacent wall of the passage.

13. The device of claim 12, wherein the passage of the pre-setting and guiding chamber is configured such that said free spaces have a height slightly less than a height of the crimped yarn, whereby portions of the adjacent walls of the passage rest against corner regions of the crimped yarn.

14. The device of claim 12, wherein said adjacent walls of the passage on the opposite sides of the crimped yarn are straight in cross-section and are parallel to each other.

15. The device of claim 14, wherein the passage is rectangular in cross-section.

16. The device of claim 14, wherein the passage is a parallelogram in cross-section.

17. The device of claim 12, wherein said adjacent walls of the passage on the opposite sides of the crimped yarn are straight in cross-section and are non-parallel to each other.

18. The device of claim 12, wherein said adjacent walls of the passage on the opposite sides of the crimped yarn are non-straight in cross-section and are generally concave toward the crimped yarn.

19. The device of claim 18, wherein the passage in cross-section defines two additional walls arranged opposite from each other for contacting two additional opposite sides of the crimped yarn, said additional walls being straight and parallel to each other in cross-section.

20. The device of claim 19, wherein each of the non-straight walls of the passage in cross-section includes a smoothly curved portion that is concave toward the crimped yarn.

21. The device of claim 18, wherein each of the non-straight walls of the passage in cross-section is made up of multiple straight segments joined to form a shape that is concave toward the crimped yarn.

22. The device of claim 11, wherein a cross-section of the channel of the compaction chamber is adjustable.

23. The device of claim 22, wherein the channel of the compaction chamber is defined between a pair of opposed doctor blades that are adjustable toward and away from each other for varying a distance between the doctor blades, thereby varying a width of the channel.

24. The device of claim 23, wherein the doctor blades are interconnected by a reverse-threaded element whose rotation in one direction or the other causes the doctor blades to be moved toward or away from each other.

25. The device of claim 11, wherein the channel of the compaction chamber is defined between a pair of opposed doctor blades that are movable toward and away from the driving rollers.

26. The device of claim 11, wherein at least a portion of the pre-setting and guiding chamber is transparent to allow viewing of the crimped yarn therein.

27. The device of claim 26, wherein the transparent portion of the pre-setting and guiding chamber is equipped with an optical monitoring means for the crimped yarn working in cooperation with an electronic comparison device.

28. The device of claim 11, further comprising a movable member arranged at an outlet of the passage of the pre-setting and guiding chamber, the movable member being arranged to selectively open and close the outlet of the passage.

29. A device for crimping yarn, comprising:

a compaction chamber defining a channel therethrough and driving rollers operable to feed a yarn into the channel so as to impart a substantially uniform crimping to the yarn; and a pre-setting and guiding chamber defining a passage connected to an outlet of the channel of the compaction chamber for receiving the crimped yarn and a pre-setting fluid for pre-setting the crimping, the passage in cross-section including wall portions on generally opposite sides of the passage that diverge from each other so as to give the passage a cross-sectional shape larger than and different from that of the channel.

30. The device of claim 29, wherein said wall portions on generally opposite sides of the passage comprise segments that are straight in cross-section.

31. The device of claim 29, wherein said wall portions on generally opposite sides of the passage comprise segments that are arcuate in cross-section.

32. The device of claim 29, wherein the passage in cross-section is generally polygonal.

33. The device of claim 32, wherein the polygonal cross-section of the passage includes arcuate portions.

* * * * *